United States Patent [19]

Millar

[11] 4,326,495

[45] Apr. 27, 1982

[54] STOVE FOR SOLID FUEL

[76] Inventor: John D. Millar, R.R. #1, Carleton Pl., Ontario, Canada, K7G 3P1

[21] Appl. No.: 145,224

[22] Filed: Apr. 30, 1980

[51] Int. Cl.[3] ..... F24C 1/00

[52] U.S. Cl. ..... 126/77; 126/60; 126/290; 126/146

[58] Field of Search ..... 126/77, 60, 80, 83, 126/198, 74, 75, 69, 146, 147, 151, 290

[56] References Cited

U.S. PATENT DOCUMENTS

| | | | |
|---|---|---|---|
| 2,564,713 | 8/1951 | Miles | 126/77 |
| 2,781,039 | 2/1957 | Kaiser et al. | 126/77 |
| 3,168,088 | 2/1965 | Martin et al. | 126/77 |
| 4,154,212 | 5/1979 | Wilkinson | 126/77 |
| 4,230,091 | 10/1980 | Judge et al. | 126/77 |

*Primary Examiner*—James C. Yeung

*Attorney, Agent, or Firm*—Achmed N. Sadik

[57] ABSTRACT

A stove for burning solid fuels such as wood and coal with improved efficiency has three generally distinct combustion zones namely a primary zone, a secondary zone and a tertiary zone, thus ensuring fuller combustion of residual combustible gases in the tertiary zone just after the primary flue exit. The novel tertiary zone is situated only at the lower portion of the base of the flue gas exit chamber, is encased by firebrick and is fed only with combustible gases from the primary zone.

4 Claims, 5 Drawing Figures

STOVE FOR SOLID FUEL

This invention relates to a stove for burning solid fuels, e.g. wood or coal. Basically, such stove is nothing more than an enclosed metal box with a few vents. Some of the devices are considerably more elaborate than others. Some are so-called non-airtight, while others are so-called air-tight. Because non-airtight stoves are so leaky, it is impossible to control the amount of air let in to regulate burning; dry wood can easily become a small inferno due to uncontrolled burning.

Air-tight stoves have an additional advantage, namely, the amount of creosote deposited in the chimney. A sticky black substance formed by unburned smoke and gas, creosote is difficult to remove, and could ignite if heated sufficiently, starting a chimney fire.

One type of such stove is the Scandinavian "horizontal baffle" design, a highly efficient stove. In it, air is sucked in facing the burning side of the wood, and, the smoke forms in the opposite end of the stove. An overhead baffle prevents the smoke from going straight up the chimney, diverting it back to the flame in the front of the box where further combustion takes place. This unit exudes very little creosote, and the baffle prevents flame from leaving the stove and igniting any deposits in the chimney.

Another type which is almost identical to the horizontal baffle type is the sidedraft type. The baffle is on the opposite side of the flame, and diverts smoke and gases back to the burning end, where they are consumed before the remnants leave the stove. This type releases a negligible amount of creosote, and the baffle prevents chimney fires. The main difference between the sidedraft type and the horizontal baffle type is that the former tends to get rid of smoke more effectively.

Still another type is the downdraft type in which the wood lies on a grate, and air is sucked in from the bottom of the unit. Burning takes place at the bottom on the wood pile, and smoke forming at the top is drawn down through the grate, where gases and smoke undergo further combustion before leaving the stove.

The art is replete with improvements in the above-identified stoves. U.S. Pat. No. 1,945,923 issues Apr. 17, 1934 to E. F. Eichhorn, purports to provide improved means in a downdraft type of heating device so as to acquire a maximum heat from fuel such as coal combusted; to provide a heating device with an improved manner of air entrainment to the combustion chamber; to provide the heating device with an improved vertically extending air passageway with which the grate bars which are hollow are cooperably connected; and to provide a heating device with improved means whereby the device can be operated either on a down draft or an open draft system of burning by means of a heating device comprising a fire pot, a combustion chamber beneath the fire pot, tubular grate bars between the fire pot and the combustion chamber, a vertically disposed air passageway leading from the grate bars at one end to the top of the fire pot, an ashpit beneath the combustion chamber, and a second passageway leading from the ashpit to the discharge flue of the device.

U.S. Pat. No. 2,461,068 issued Feb. 8, 1949, to L. Lockwood, purported to provide: a furnace of the magazine down draft type which is relatively light in weight and inexpensive in construction; a furnace of the type employing a magazine to receive a charge of fuel of such an amount that it needs to be charged only once or twice a day, of such construction that a predetermined temperature level may be maintained for a number of hours, say six or eight, without changing damper adjustments; a furnace in which the thin sheet metal walls of the combustion chamber at the area where the maximum combustion occurs, is prevented from burning out or being destroyed by heat by the utilization of the incoming air which is necessary for combustion purposes, in forming a constantly flowing stream of cool air directly over the outer surface of the sheet metal forming the combustion chamber, to thereby perform the double function of maintaining the sheet metal at such temperature as to prevent the heat against the inner surface from burning out the sheet metal, and at the same time pre-heating the air just prior to its entrance into the combustion chamber to aid combustion, and whereby a substantial reduction in the weight of the furnace is effected by the elimination of the necessity for such linings; a furnace of standard construction which may be manufactured by so-called quantity production and which will operate successfully with all of the various classes or kinds of coal ordinarily used for furnaces and which may be fueled with a large enough amount of coal to burn for a long period of time, for instance twenty-four hours, and which will automatically prevent the coal from caking or sticking to the sides of the fuel magazine so that it feeds by gravity to the combustion area until the magazine is completely emptied without any attention on the part of an operator; a furnace in which any gases that may be accumulated in the upper portion of the fuel magazine are drawn downwardly into the combustion area and consumed, thereby serving a useful heating function and at the same time preventing the creation of creosote and thereby avoiding the injurious results produced by creosote in the upper portion of the fuel magazine and on the fuel door; a furnace of this class in which air for combustion purposes is fed to the combustion area and the lower part of the fuel magazine in a downwardly moving path around the entire inner surface of the fuel magazine and the entire outer surface of the column of coal, whereby combustion takes place more rapidly and completely at this point, thereby forming a cylindrical column of coked coal and ashes around the unburned column of coal, thereby preventing the coal from sticking to the fuel magazine and permitting it to freely move by gravity to the combustion area, and this regardless of whether the area under combustion at any given time is at its maximum or its minimum; and to provide means for maintaining the upper portion of the fuel magazine in a relatively cool condition to thereby prevent the generation of an excessive amount of gas within the fuel magazine without impairing the heat radiating capacity of the furnace casing.

U.S. Pat. No. 2,481,165 issued Sept. 6, 1949 to B. A. Landy, purports to provide apparatus for burning solid fuel and more particularly to a down and cross draft heater including an air tight ash pit and wherein substantially smokeless combustion is achieved simultaneously with continuous feed. The patentee purports to provide such an apparatus for effecting essentially smokeless combustion of normally smoky fuels, in which poking is eliminated by introducing air into the fuel space in such as a manner as to remove and/or oxidize the volatiles from the fuel, as well as to produce an ignition rate that is higher than the rate of burning;

and to provide a smokeless solid fuel burning heater which is characterized by essentially smokeless combustion, freedom from the necessity of poking and freedom from "puffing". The patentee bases his alleged invention on the application of the principle that when a coking coal is heated while air is passing around the individual pieces, so that the final mass consists essentially of separate or distinct non-packing or non-uniting coke pieces, to provide a heater or apparatus for burning solid fuel, wherein means are provided for preventing caking or agglomeration of the fuel.

U.S. Pat. No. 4,051,831 issued Oct. 4, 1977 to E. P. Schellers, allegedly provides a stove having improved fuel economy, by controlling the amount of air available to the combustion process. This is effected by virtue of the use of a substantially air-tight fire box structure, such stove operates at a pressure less than atmospheric, which results in more complete ultimate combustion of the fuel, as well as less ash accumulation. Combustion air is introduced from the top of the fire box through one or more downwardly directed draft tubes, that can be closely controlled by regulator means. Thus, the only air available in the fire box is that which passes through the draft tube, as the structure is otherwise air-tight. The combustion air introduced through the draft tubes is supplied at pre-selected points and maximum velocity consistent with the draft available to produce a superior effect in control and efficiency of combustion. Such alleged unique down draft system results in a fire that burns from the top down, and effectively burns all the fuel with little ash residue. The patentee thus provides a heating stove for burning woodlike organic material having a fire box for receiving material to be burned substantially centrally therein. The walls of the fire box are sealed to render it substantially air-tight. At least one substantially vertically aligned draft tube depends downwardly from the cover of the fire box into the interior thereof for receiving combustion air at substantially atmospheric conditions from the upper end thereof and directing a flow to impinge upon the hearth adjacent the material to be burned from above and substantially in a vertical direction. Flue means are mounted on the fire box above the material to be burned and in spaced relationship with respect to the draft tube for removing the products of combustion and maintaining the fire box at a pressure below atmospheric pressure.

Other improvements in such stoves are believed to be provided by the following patents:

| U.S. Pat. Nos. | | |
|---|---|---|
| 974,290 | 11/1910 | Merritt |
| 995,705 | 6/1911 | Neel |
| 998,800 | 7/1911 | Quigly |
| 1,028,928 | 6/1912 | Broussard |
| 1,044,724 | 11/1912 | Atteberry |
| 1,214,131 | 1/1917 | Canterbury |
| 1,297,183 | 3/1919 | Kinney |
| 2,352,567 | 6/1944 | Raulston |
| 3,196,842 | 7/1965 | Huge et al |
| Other Patent | | |
| 128,863 | 7/1940 | Sweden |

In spite of these many patents, the art is still faced with the problem of providing a stove which is efficient in its consumption of fuel, and relatively clean and convenient with respect to the removal of waste products, such as ash and cinder removal, as well as producing a minimum amount of creosote.

Accordingly, the present invention aims to provide an improved such stove. By a broad aspect of this invention, an air-tight stove is provided for the combustion of solid fuels comprising a chamber defined by a metal casing, and including a floor, a pair of end walls, a front wall, a back wall, means for the feeding of solid fuel thereinto, a ceiling and means to permit controlled admission of oxygen-containing gas, said stove further containing a compound combustion chamber comprising: (a) a primary lower firebox zone on the floor thereof, for the burning of the solid fuel therein; (b) a secondary upper combustion zone disposed between the primary lower firebox zone and the ceiling, and communicating in an unhindered fashion with the primary lower firebox zone, for the secondary combustion of any combustible gases released by the combustion of the solid fuel in the primary lower firebox zone; (c) an upstanding dorsal flue gas exit chamber contiguous with the back wall; (d) a tertiary lower rear combustion zone only at the lower portion of the base of the flue gas exit chamber, the tertiary combustion zone being encased by firebrick lining and being fed exclusively by a gaseous mixture of partial and complete products of combustion from the primary lower firebox zone, for the tertiary combustion of any combustible gases released by the combustion of the solid fuel in the primary lower firebox zone, the outlet from the tertiary combustion zone leading directly and in an unhindered fashion to the flue gas exit chamber; (e) a primary outlet flue from the rear lower portion of the tertiary combustion zone for unhindered access of the gaseous mixture of partial and complete products of combustion from the primary lower firebox zone to the tertiary combustion zone; and (f) a secondary outlet flue from the rear upper portion of the secondary combustion zone to the flue gas exit chamber, the secondary outlet including a damper therein, operable selectively to discharge gases from the primary combustion zone to the flue gas exit chamber.

By a variant thereof, the stove includes a firebrick lining of of the primary lower firebox zone and at the rear wall between the secondary combustion zone and the dorsal flue gas exit chamber.

By another variant, the tertiary combustion chamber is firebrick lined in the vicinity of the primary outlet flue.

By another variant, the front wall includes a pair of doors, each being provided with sealing means to provide an air-tight seal.

By a variation thereof, the doors are each provided with a rotary air inlet damper valve.

In the accompanying drawings.

Figure 1:
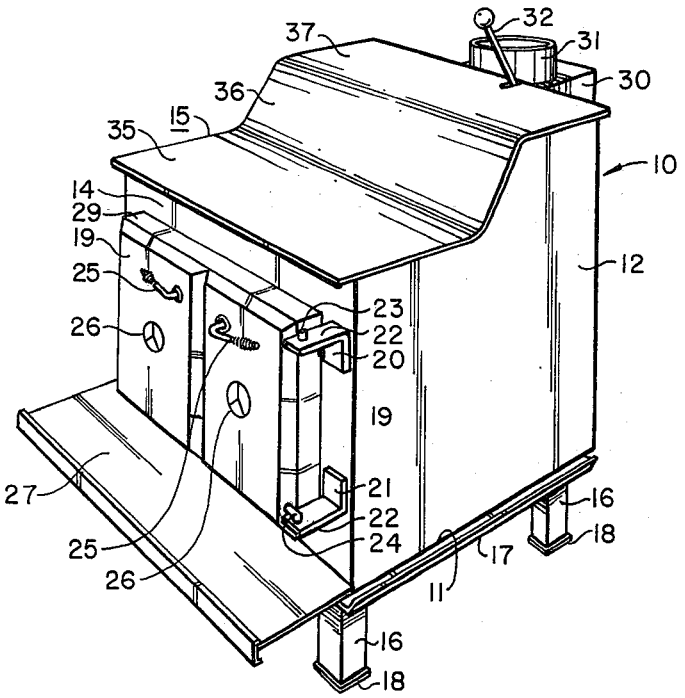
FIG. 1 is a perspective view of the stove of one embodiment of this invention.
Figure 2:
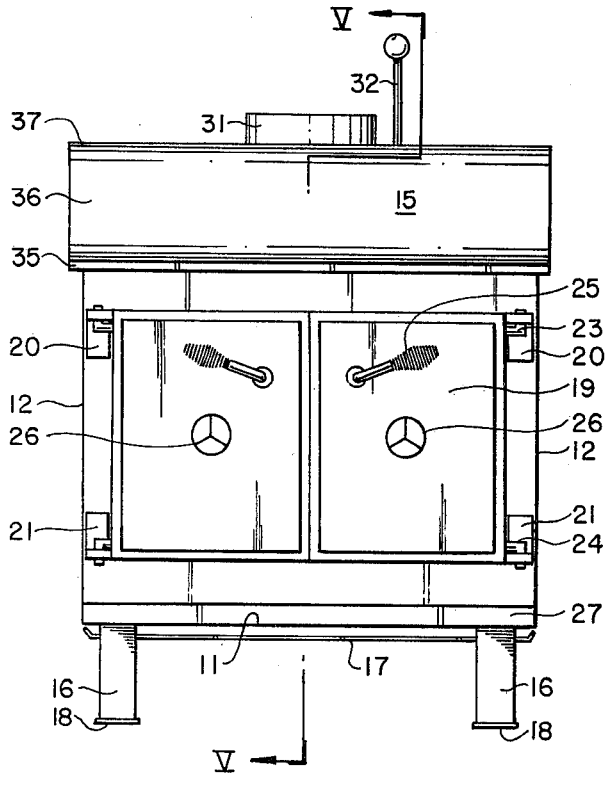
FIG. 2 is a front elevational view of the stove of FIG. 1.
Figure 3:
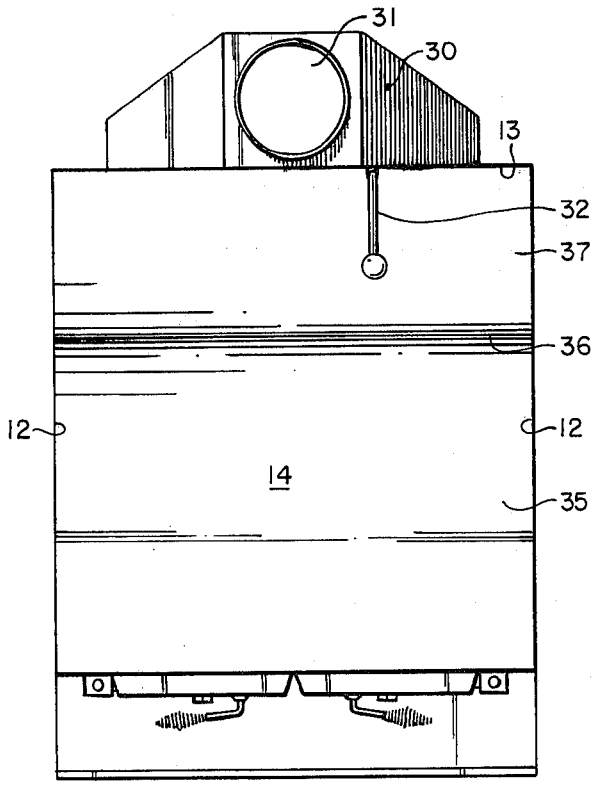
FIG. 3 is a top plan view of the stove of FIG. 1.
Figure 4:
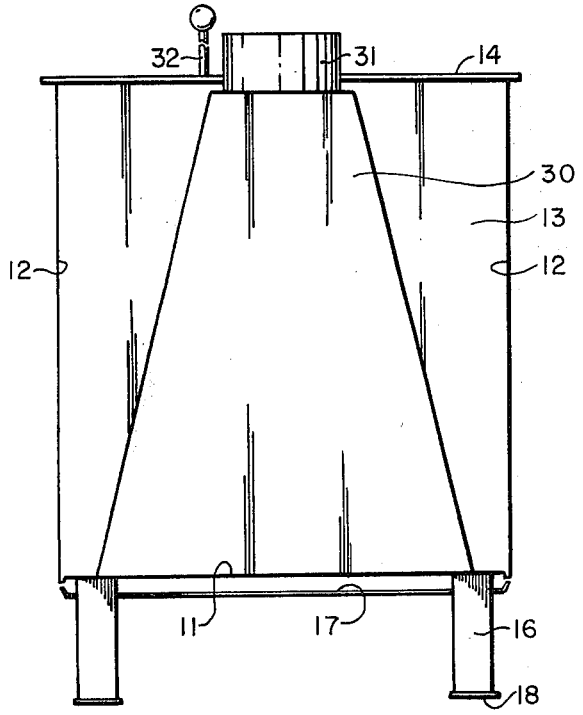
FIG. 4 is a rear elevational view of the stove of FIG. 1.

The stove 10 of the preferred embodiment of this invention is a generally rectangularparallelepiped box including a bottom 11, a pair of end walls 12, a rear wall 13, a front wall 14, and a bi-level top wall 15. The stove is supported on four hollow rectangular legs 15. The bottom 11 is shielded from the floor upon which the stove 10 is to be mounted by a rectangular shield pan 16 secured to legs 15 near the upper ends thereof. The bases of the legs 15 are each provided with floor caps 17.

The front wall 14 is provided with a rectangular framed opening 29, closed by a pair of doors 19. Each door 19 is hingedly mounted by gate hinges provided by upper el-shaped bracket 20 and lower el-shaped bracket 21, each provided with a pivot aperture 22. The upper outer edge of each door 19 is provided with an el-shaped, unwardly extending hinge pin 23, and similarly the lower outer edge of each door 19 is provided with an el-shaped, downwardly extending hinge pin 24. Hinge pins 23, 24 are freely swingably mounted in respective pivot apertures 22. The doors are also provided with latches 25 to maintain the doors closed. The doors are sealed closed by means of a perimetral asbestos rope door seal 28. The doors 19 are also each provided with rotary air inlet damper valves 26, so that the amount of combustion air can be controlled. The front of the stove 10 is also provided with a rectangular extension hearth 27.

The rear wall is provided in this preferred embodiment with a trapezoidally shaped dorsal flue gas exit chamber 30 whose cross-sectional area decreases both in a frontal sense and in a side-elevational sense from the bottom to the top thereof. The upper end of the flue gas exit chamber 30 leads to a flue pipe fitting 31, which is to be connected to a chimney (not shown). Also seen is a damper control lever 32.

A feature of the preferred stove 10 is that the top wall 15 is a bi-level wall. That is, wall 15 includes a frontal flat surface 35, an upwardly sloping frontal face 36, and a dorsal flat surface 37.

Figure 5:
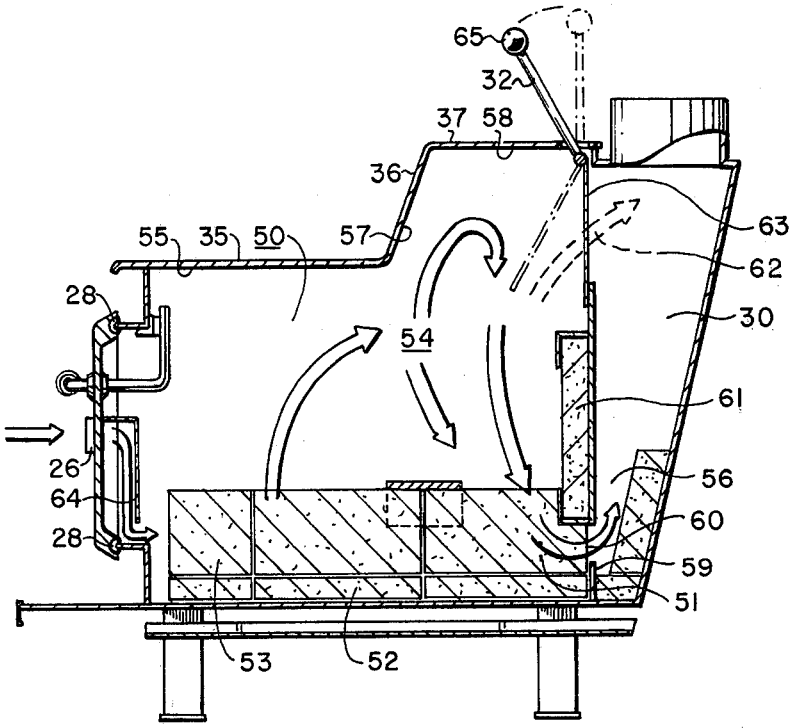
FIG. 5 is a section along the line V of FIG. 2.

The internal structure of the stove is shown in FIG. 5. Here, the combustion chamber 50 is provided by a lower firebox zone 51. Firebox zone 51 is provided with a lower floor of firebrick 52 and end walls lined with firebrick 53. Firebrick 53 extends somewhat above the firebox zone 51.

Above firebox zone 51 is a secondary combustion zone 54, disposed forwardly between the upper limit of the firebox zone 51 and the ceiling 55, defined by the inner face of the frontal flat surface 35. Generally speaking, the secondary combustion zone may extend rearwardly between the upper limit of the firebox zone 51 and the ceilings 57, 58 defined by the inner surfaces of the sloping frontal face 36 and the dorsal flat surface 37.

The rear wall 14 is provided, on its inner surface with a lower, firebox zone baffle 59, a primary unrestricted outlet flue 60, a firebox lined intermediate face 61, and a secondary normally closed outlet flue 62. Outlet to flue 62 is closed by a damper 63, whose operation is controlled by a lever 32, in a manner to be described hereinafter.

In operation, the firebox 51 is loaded with solid combustible fuel, e.g. wood or coal, to a level such that there is unhindered access to outlet flue 60. Combustion is then started, and oxygen to support combustion is admitted in controlled amounts through rotary damper valve 26. Air flow is directed to the solid fuel by means of internal baffle 64, which also permits air flow from both sides.

Smoke and other gaseous products of combustion rise into the secondary combustion zone 54 where further calorific values are extracted by further combustion. The products of the still incomplete combustion are then drawn into the flue gas exit chamber 30 through the primary outlet flue 60. Upon the exit of the normally not fully combusted gases through the primary outlet flue 60, they are reignited in a tertiary combustion zone 56 at the base of the flue gas exit chamber 30. Normally this is the final combustion step, which is assisted by the intense heat emanating from the primary outlet flue 60. It is thus, at least in the stove of the preferred embodiment, necessary to firebrick line the lower reaches of the flue gas exit chamber. Because of the zones of combustion, the efficiency of combustion of solid fuel is optimized. Also because the primary outlet flue is below most of the solid fuel, gaseous products of combustion are reheated through the hot embers, thus probably causing better combustion in the tertiary zone.

Damper 63 is opened to vent smoke, when doors 19 are opened by means of lever 32 and handle 65. Normally it is fully satisfactory that the damper 63 has two positions, open and closed.

Control of the extent of combustion may be achieved by control of the inlet air through rotary damper valves 26.

What is claimed is:

1. An air-tight stove for the combustion of solid fuels comprising a chamber defined by a metal casing, said chamber including a floor, a pair of end walls, a back wall, a front wall, means for feeding of solid fuel thereinto, a ceiling and means to permit controlled admission of oxygen-containing gas, said stove further containing a compound combustion chamber comprising:

(a) a primary lower firebox zone on said floor thereof, for the burning of the solid fuel therein;

(b) a secondary upper combustion zone disposed between said primary lower firebox zone and said ceiling, and communicating in an unhindered fashion with said primary lower firebox zone and being fed with a gaseous mixture of partial and complete products of combustion from said primary lower firebox zone, for the secondary combustion of any combustible gases released by the combustion of said solid fuel in said primary lower firebox zone;

(c) an upstanding dorsal flue gas exit chamber contiguous with said back wall;

(d) a tertiary lower rear combustion zone only at the lower proof the base of said flue gas exit chamber, said tertiary combustion zone being encased by firebrick lining and being fed exclusively by a gaseous mixture of partial and complete products of combustion from said primary lower firebox zone, for the tertiary combustion of any combustible gases released by the combustion of said solid fuel in said primary lower firebox zone, the outlet from said tertiary combustion zone leading directly and in an unhindered fashion to said flue gas exit chamber;

(e) a primary outlet flue from the rear lower portion of said tertiary combustion zone for unhindered access of said gaseous mixture of partial and complete products of combustion from said primary lower firebox zone to said tertiary combustion zone; and (f) a secondary outlet flue from the rear upper portion of said secondary combustion zone to said flue gas exit chamber, said secondary outlet including a damper therein, operable selectively to discharge gases from said primary combustion zone to said flue gas exit chamber.

2. The stove of claim 1 including a firebrick lining of said primary lower firebox zone and at the rear wall between said secondary combustion zone and said dorsal flue gas exit chamber.

3. The stove of claim 1 wherein the front wall includes a pair of doors, each being provided with sealing means to provide an air-tight seal.

4. The stove of claim 3 wherein said doors are each provided with a rotary air inlet damper valve.

* * * * *